US005147256A

United States Patent [19]

Silagy

[11] Patent Number: 5,147,256

[45] Date of Patent: Sep. 15, 1992

[54] COMBINATION INDIVIDUAL FINGER AND ENTIRE HAND EXERCISER

[76] Inventor: Howard Silagy, 265 Post Ave., Westbury, N.Y. 11590

[21] Appl. No.: 789,945

[22] Filed: Nov. 12, 1991

[51] Int. Cl.[5] ..... A63B 23/16; A63B 21/05

[52] U.S. Cl. ..... 482/47; 482/128; 482/49

[58] Field of Search ..... 482/44, 47, 49, 121, 482/128; 84/465, 467; 602/22; 128/26

[56] References Cited

U.S. PATENT DOCUMENTS

| | | | |
|---|---|---|---|
| 835,873 | 11/1906 | Thompson | 482/49 |
| 843,291 | 2/1907 | Mullins | 482/49 |
| 1,487,631 | 11/1920 | Wanger | 482/49 |
| 1,602,709 | 10/1926 | Sandow | 482/49 |
| 1,796,216 | 5/1930 | Pettersson | 482/47 |
| 2,837,334 | 10/1955 | Long | 482/49 |
| 3,003,764 | 10/1958 | Yovanovitch | 482/49 |
| 3,738,651 | 6/1973 | Norman et al. | 482/47 |
| 4,678,181 | 7/1987 | Ditsch et al. | 482/47 |

*Primary Examiner*—Richard J. Apley
*Assistant Examiner*—Lynne A. Reichard

[57] ABSTRACT

A resistance spring-type exerciser for optionally exercising individual fingers, or an entire hand, in which, for individual finger exercises, individual finger-gripped members are closed in a first direction against the resistance of a first set of springs, and, for exercising an entire hand, a second set of springs is operationally added to the first set by requiring closing movement thereagainst from a second direction opposite to the already noted first direction closing movement.

3 Claims, 1 Drawing Sheet

COMBINATION INDIVIDUAL FINGER AND ENTIRE HAND EXERCISER

The present invention relates to improvements for a hand exerciser of the type in which engaged elements or components are pressed against the resistance or urgency of exercise springs wherein the user is given the option of exercising selected individual fingers or the entire hand, and the resistance of the springs is appropriately matched to the exercising mode that is selected.

EXAMPLE OF THE PRIOR ART

Routines contemplating the exercising of fingers against the resistance of springs is embodied in the construction and operational mode of many prior art hand exercising devices, as exemplified by the hand exercising device illustrated and described in U.S. Pat. No. 3,738,651 issued to Donald Norman on June 12, 1973 for "Finger, Hand And Forearm Developer". Individual resistance springs are provided for plungers or finger grips for all but the thumb, and are selectively pressed for individual finger exercises. All four finger grips are pressed for an entire hand exercise which, of course, is against the cumulative resistance of all four springs. The user's strength in the use of an entire hand however, is greater than that of the cumulative strength of the individual fingers, and thus an increased adjustment in spring resistance in the entire hand exercising mode should be made for maximum benefit to the user.

It is an object of the present invention to provide an improved combination individual finger and entire hand exercise devise overcoming the foregoing and other shortcomings of the prior art. More particularly, it is an object to provide an exerciser having different extents of resistance to individual finger exercise and entire hand exercise, wherein the latter is not merely the cumulative resistance of the former, so that the resistance is a function of the strength of the user in the selected exercise mode, and correspondingly provides maximum exercising benefit to the user.

The description of the invention which follows, together with the accompanying drawings should not be construed as limiting the invention to the example shown and described, because those skilled in the art to which this invention appertains will be able to devise other forms thereof within the ambit of the appended claims.

Figure 2:
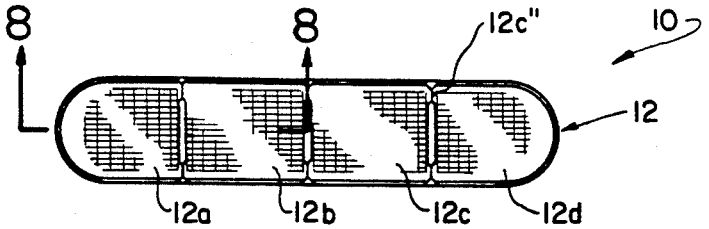
FIG. 2 is a plan view of said exerciser.
Figure 8:
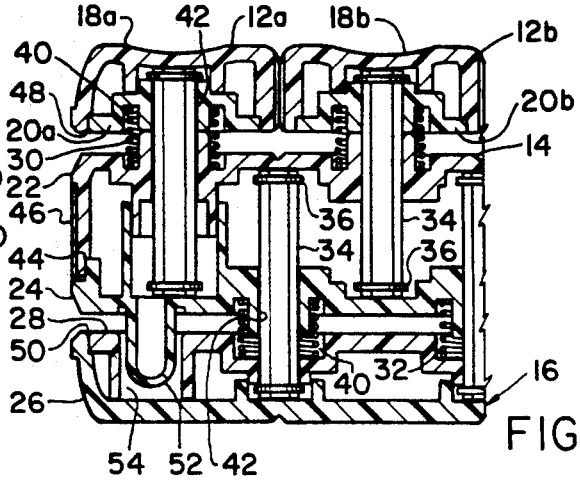
Figure 7:
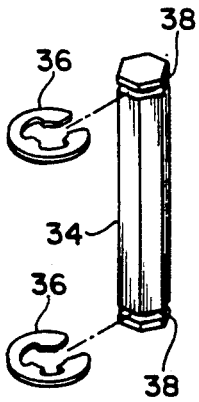

FIG. 7 is an isolated perspective view of a pin assembly used as a core support on each of the exercising springs; and FIG. 8 is a partial cross sectional view taken along line 8—8 of FIG. 2 similar except for the cross sectional showing, to FIG. but showing the three body members after closing movement of the two outer body members against the third body member in interposed position therebetween.

Figures 1, 3, 4:
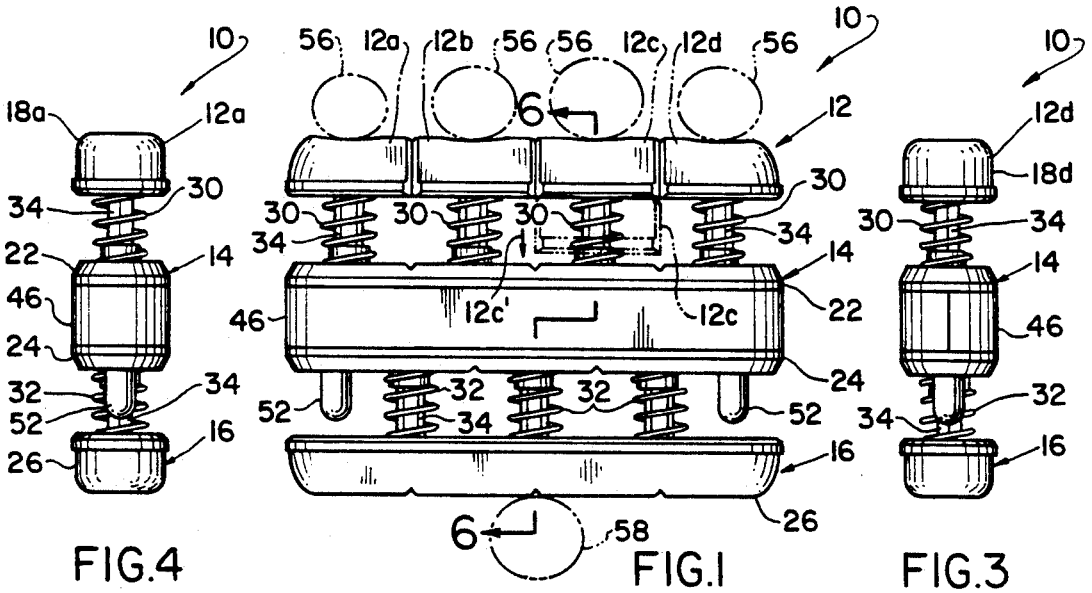
FIG. 1 is a front elevation of the within inventive individual finger and entire hand exerciser with the three body members thereof in their starting clearance position relative to each other prior to exercising use thereof.
FIG. 3 is a right end view thereof.
FIG. 4 is a left end view thereof.

As best seen in FIG. 1, an optional individual finger or entire hand exercise unit 1? , according to the present invention, is comprised of an operative arrangement of three cooperating body members, namely an upper body member 12, a middle or centrally disposed body member 14 and a lower body member 16. Body member 12 is provided to promote individual finger exercising and specifically to this end is composed of four adjacent individually independently slidable finger grips 12*a*, 12*b*, 12*c*, and 12*d*. The other two body members 14 and 16 are unitary structures, the bottom body member 16 (as viewed in FIG. 1) being provided to promote entire hand exercising, as will be better understood as the description proceeds.

Each of one upper body member finger grips 12*a*, 12*b*, 12*c*, 12*d* and also the body members 16 embody the same construction concept of being formed of two molded plastic parts that functionally serve as a base and cap and which are designed to be fitted and cemented to each other at final assembly. Thus using finger grip 12*c* shown in cross section in FIG. 6 as exemplary of the similarly constructed finger grips 12*a*, 12*b* and 12*d*, finger grip 12*c* has a cap 18*a* and a base 20*a*, while each of body members 14 and 16 similarly has a cap 22 base 24 and a ca 26 and base 28, respectively. Exposed caps 18*a*, 18*b*, 18*c* and 18*d* of the upper body member 12 have a knurled and contoured upper surface, while the exposed cap 26 of the bottom body member 16 has a flat knurled lower surface.

Upper body member 12, and more particularly the finger grips 12*a–d* thereof, are maintained in an initial clearance position from the centrally disposed body member 14 by a first set of four spaced apart adjacent exercising springs 30, while lower body member 16 is similarly held in an initial clearance position from the opposite side of body member 14 by a second set of three spaced apart adjacent exercising springs 32. First and second spring sets 30 and 32 are disposed in offset relation to each other in the finished unit 10 to contribute to uniform distribution of spring resistance during exercising use thereof. At assembly, a set of seven guide pins 34 are arranged to be located axially within a cooperating one of the helical springs 30 and 32 which are disposed in encircling relation about the pin. At each end of pins 34 a groove 38 is provided to receive in a snap fit two C-rings 36, as best shown in FIG. 7, during assembly. The inboard ends of the pins 34 are slidable in the middle body member 14 so that upon release of the other body members 12 and 16 and expansion of the springs 30 and 32, the C-rings 36 on said inboard ends limit the outward movement of the body members 12 and 16 and thus provide the initial starting clearance positions thereof relative to the centrally disposed body member 14.

The assembly of the exerciser 10 is facilitated by sequential assembly of the pins 34 and springs 30 and 32, of the two spring exercising sets to extend in opposite directions from the middle body member 14, followed by assembly of the previously noted bases 20 and 28 of the other body members 12 and 16 to the free ends of the pin and spring assemblies, and they in a final assembly step capping the bases 20 and 28 with their cooperating previously noted caps 18 and 26 respectively. Alternatively, the capped bases 20 and 28 can be attached to the pins 34 and the opposite pin ends then slidably disposed from opposite directions into the middle body member 14.

Figure 6:
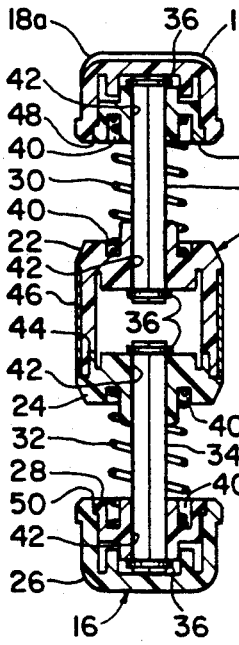
FIG. 6 is a cross sectional view as taken along line 6—6 of FIG. 1.
Figure 5:
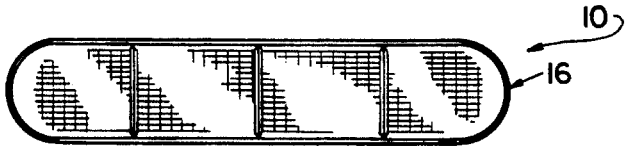
FIG. 5 is a bottom view thereof.

Thus, with particular reference to the cross sectional views of FIGS. 6 and 8, the optional assembly procedure contemplates a first sub-assembly being made with an upper body member base 20*a* and a middle body member cap 22 with a spring 30 interposed therebetween. Upper and lower ends of each spring 30 is aligned and placed in an appropriate spring seat 40. Base 20*a* is moved towards cap 22 thus compressing spring 30. A hexagonal pin 34 is at this time passed through aligned hexagonal bores 42 in both base 20*a* and cap 22. With spring 30 still compressed, a pair of C-rings 36 are applied to the exposed grooves 38 on the opposite ends of the pins 34. Spring 30 is then allowed to expand, whereupon it forces base 20*a* and cap 22 against the now installed C-rings 38 on the ends of the pins 34.

Following the above described procedure, a second, third and fourth sub-assemblies for the finger grips 12*b*, 12*c* and 12*d* are added to medial body member cap 22 further encapsulating the remaining three springs 30, and using three pins 34 and six C-rings 36, as already described. The sub-assembly of finger grip bases 20*a*, 20*b*, 20*c* and 20*d* to cap 22 is now temporarily laid aside.

A fifth sub-assembly is advantageously likewise completed at this time wherein three pins 34, six C-rings 36, a base 24 and a base 28 are assembled together. Springs 32, captive in respective seats 40 are compressed between base 24 and base 28 while pins 34 are inserted in shaped bores 42 and C-rings 36 are applied to respective end grooves 38 of each pin 34. Upon release of the compression applied on the springs 32, bases 24 and 28 are forced against the C-rings 36 previously seated or installed in grooves 38 on the pins 34.

A sixth and final assembly is at this time advantageously made by joining the above described first through fourth sub-assemblies to the fifth sub-assembly along a seam 44. A foil tape 46, with commercial indicia thereon, is preferably used to both attach the components together and provide a finished appearance to the perimeter of middle body member 14.

Each of the bases 20*a*, 20*b*, 20*c* and 20*d* is then "capped" with its respective cooperating cap 18*a*, 18*b*, 18*c* and 18*d* along a seam 48. As a result, the upper ends and the C-rings 36 of the upper ends of the four pins 34 are now captive within upper body member 12. A like procedure is then used to join a cap 26 to the lower body member base 28 along a seam 50. Here also, the result is that the lower ends and the C-rings 36 of the lower three pins 34 are similarly held captive within the lower body member 16.

A pair of dependent guide pins 52 on the outer ends of the lower face of body member 14 align with a pair of suitable and appropriately located apertures 54 on body member 16 to assist in the closing tracking movement of the body members 14 and 16 relative to each other.

It is helpful to note at this point in the description that the inboard ends of the pins 34 are slidably disposed in the middle body member 14 extending, as best shown in FIG. 6, into clearance or voids of a selected dimension left between the cap 22 and base 24 of the body member 14. Thus, when springs 30, 32 are fully compressed, an operative condition illustrated in FIG.8, the inboard ends of pins 34 within body member 14 "bottom out" against the upper and lower walls bounding the referred to clearances or voids of member 14.

The exercising use of the within inventive exerciser 10 contemplates providing the user with an option of individual finger exercise routines, or an entire hand exercising routine. In the exercise of one or more individual fingers, but less than the fingers of the entire hand, a selected finger grip, such as finger grip 12*c* of FIG. 1, is depressed against the resistance of its cooperating spring 30, thus resulting in finger grip 12*c* being urged from an initial starting clearance position as illustrated in full line in FIG. 1, through closing movement 12*c*, against middle body member 14, as illustrated in phantom perspective in FIG. 1. During this closing movement 12*c*', an adjacent finger grip, in this example being the finger grips 12*b* on the left and 12*d* on the right, by remaining in their raised clearance positions effectively contribute to proper tracking of the moving finger grip 12*c* during the closing movement 12*c*, thereof. To this end, the finger grips 12*a–d* are in adjacent touching contact at their confronting sides as represented by the designated line contact 12*c*", only one of which for simplicity being designated in the plan view of FIG. 2. During individual finger exercising using one or more fingers 56 to depress the selected finger grip against a cooperating exercising spring 30 of the set of four thereof, the thumb of the user represented by the finger designated 58 in FIG. 1 is passive.

However, when the exerciser 10 is used for an entire hand exercise routine, the thumb 58 is active, along with the four fingers 56 in compressing body members 12 and 16 in closing movements from opposite directions against the middle body member 14. Appropriate for an entire hand exercise, the closing movements of the body members 12 and 16 are against the cumulative resistance of both sets of all seven exercising springs 30 and 32.

While the finger and hand exerciser herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A combination individual finger and entire hand exerciser comprising in an operative arrangement of three cooperating body members a first body member having a centrally disposed position in said arrangement, said centrally disposed first body member having a set of four and a set of three adjacently spaced apart exercising springs operatively mounted to extend in opposite directions therefrom, said second body of said arrangement for promoting individual finger-exercising use consisting of cooperating four adjacent independently slidable finger grips each mounted on a cooperating one of said set of four exercising springs so that incident to individual finger exercising a selected finger grip is depressed for urging same from an initial clearance position through closing movement against said first body member while an adjacent non-depressed finger grip remaining in its clearance position contributes to the tracking of said moving finger grip during said closing movement, and said third body member of said arrangement for prompting entire hand-exercising use mounted on said set of three exercising springs so that incident to entire hand exercising both said second and third body members are simultaneously closed from opposite directions against said centrally located first body member against the resistance of cooperating individual exercise springs and entire hand exercising against the resistance of all exercise springs is available.

2. A combination individual finger and entire hand exerciser as claimed in claim 1 wherein said exercising springs of said first and second sets are spaced in offset relation to each other to contribute to uniform distribution of spring resistance during exercising use thereof.

3. A combination individual finger and entire hand exerciser as claimed in claim 2 wherein each exercising spring is formed as a helical coil and is disposed in encircling relation about a pin slidably disposed at one end thereof in said centrally disposed first body member so as to allow compression of said exercising springs during exercising, each said pin having C-ring means on said sliding end to limit reverse direction sliding movement upon expansion of said exercising springs, to thereby provide said initial clearance positions respectively to said finger-exercising and entire hand-exercising other two body members.

* * * * *